US009416610B2

(12) United States Patent
Dotson

(10) Patent No.: US 9,416,610 B2
(45) Date of Patent: Aug. 16, 2016

(54) APPARATUS AND METHOD FOR ABRASIVE JET PERFORATING

(75) Inventor: Thomas L. Dotson, Woodburn, KY (US)

(73) Assignee: TD TOOLS, INC., Woodburn, KY (US)

( * ) Notice: Subject to any disclaimer, the term of this patent is extended or adjusted under 35 U.S.C. 154(b) by 5 days.

(21) Appl. No.: 13/507,971

(22) Filed: Aug. 9, 2012

(65) Prior Publication Data

US 2014/0102705 A1 Apr. 17, 2014

(51) Int. Cl.
*E21B 43/114* (2006.01)
*E21B 29/00* (2006.01)
*E21B 43/26* (2006.01)

(52) U.S. Cl.
CPC ..... *E21B 29/00* (2013.01); *E21B 43/114* (2013.01); *E21B 43/26* (2013.01)

(58) Field of Classification Search
CPC ..... E21B 43/114; E21B 43/112; E21B 43/26
USPC ..... 166/297, 298, 55, 222
See application file for complete search history.

(56) References Cited

U.S. PATENT DOCUMENTS

| | | | | |
|---|---|---|---|---|
| 3,130,786 | A | 4/1964 | Brown et al. | |
| 3,145,776 | A * | 8/1964 | Pittman | 166/55 |
| 3,266,571 | A | 8/1966 | St. John et al. | |
| 4,050,529 | A * | 9/1977 | Tagirov et al. | 175/424 |
| 4,921,044 | A * | 5/1990 | Cooksey | 166/116 |
| 5,445,220 | A * | 8/1995 | Gurevich et al. | 166/55 |
| 5,499,678 | A * | 3/1996 | Surjaatmadja et al. | 166/298 |
| 5,765,756 | A * | 6/1998 | Jordan et al. | 239/204 |
| 6,491,097 | B1 * | 12/2002 | Oneal et al. | 166/278 |
| 7,159,660 | B2 | 1/2007 | Justus | |
| 7,497,259 | B2 | 3/2009 | Leising et al. | |
| 2006/0076137 | A1 * | 4/2006 | Malone et al. | 166/298 |
| 2009/0071640 | A1 * | 3/2009 | Ivanov et al. | 166/55.2 |
| 2010/0212903 | A1 * | 8/2010 | Dotson et al. | 166/298 |

OTHER PUBLICATIONS

Dictionary Definition "Protective"; http://www.thefreedictionary.com/protective.*
Dictionary Definition: "mechanical"; http://www.thefreedictionary.com/mechanical.*
J.S.Cobbett, "Sand jet perforating revisited", SPE 55044, SPE Drill. & Completion, vol. 14, No. 1, Mar. 1999, p. 28-33.
Gensheng Li et al., "Abrasive Water Jet Perforation—An alternative approach to enhance oil production", Petroleum Science and Technology, vol. 22, Nos. 5 & 6, p. 491-504, 2004.
S.W. Loving et al., "Abrasive cutting technology deployed via coiled tubing", SPE 92866, SPE/ICoTA Coiled Tubing Conf. and Exhib., Apr. 2005.
B.W. McDaniel et al., "Use of hydrajet perforating to improve fraturing success sees global expansion", SPE 114695, CIPC/SPE Gas Tech. Sympos., Jun. 2008.

* cited by examiner

*Primary Examiner* — Blake Michener
*Assistant Examiner* — Christopher Sebesta
(74) *Attorney, Agent, or Firm* — Norton Rose Fulbright US LLP

(57) ABSTRACT

An apparatus for performing abrasive jet perforating in a well comprises a generally cylindrically shaped tube with a side, an upper portion, and a lower portion; a plurality of smooth holes drilled into the side of the tube; abrasive jets mounted in at least some of the plurality of smooth holes; protective plates mounted in the side of the tube and surrounding the abrasive jets to hold the abrasive jets in place; wafers recessed into pockets on the protective plates and surrounding the abrasive jets to protect the abrasive jets from damage due to rebound of abrasive-carrying fluid slurry ejected by the abrasive jets; and fasteners securing the protective plates to the side of the tube and positioned away from the rebound of abrasive-carrying fluid slurry ejected by the abrasive jets.

9 Claims, 4 Drawing Sheets

APPARATUS AND METHOD FOR ABRASIVE JET PERFORATING

CROSS-REFERENCES TO RELATED APPLICATIONS

Not Applicable

FEDERALLY SPONSORED RESEARCH OR DEVELOPMENT

Not Applicable

SEQUENCE LISTING, TABLE, OR COMPUTER LISTING

Not Applicable

BACKGROUND OF THE INVENTION

1. Field of the Invention

This invention relates generally to the field of treating wells to stimulate fluid production. More particularly, the invention relates to the field of abrasive jet perforating in oil and gas wells.

2. Description of the Related Art

Abrasive jet perforating (AJP) uses fluid slurry pumped under high pressure to perforate tubular goods around a wellbore, where the tubular goods include tubing, casing, and cement. Since sand is the most common abrasive used, this technique is also known as sand jet perforating (SJP). Abrasive jet perforating was originally used to extend a cavity into the surrounding reservoir to stimulate fluid production. It was soon discovered, however, that abrasive jet perforating could not only perforate, but cut (completely sever) the tubular goods into two pieces. Sand laden fluids were first used to perforate and cut well casing in the 1930's.

Abrasive jet perforating was eventually attempted on a commercial scale in the 1960's. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the use of coiled tubing to convey the abrasive jet perforating tool down a wellbore has led to reduced run time at greater depth. Further, abrasive jet perforating does not require explosives and thus avoids the accompanying danger involved in the storage, transport, and use of explosives. However, the basic design of conventional abrasive jet perforating tools used today has not changed significantly from those used in the 1960's.

Abrasive jet perforating tools and casing cutters were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

Abrasive jet perforating tools are typically sized appropriately for the casing. Occasionally a centralizer is used with the tool to keep it from touching the low side of the casing. Abrasive jet perforating tools typically have a uniform outer diameter, with the exception of the mounting location for the jets.

An important concern for abrasive jet perforating tools is protecting them from the damage caused by the splash back of the pressurized abrasive fluid. This splash back can cut tool components as easily as it cuts the target tubing. Greater resistance to damage from this splash back translates into increased run time and life for the tool while downhole. The demand is high for numerous sets of perforations to be performed in one trip downhole as many different treatment stages may be employed.

Another challenge for abrasive jet perforating is creating a hole or window in the casing that is larger than the hole naturally created by the spraying fluid. The traditional threaded jet configuration is limited by its size to the proximity of spacing between the abrasive jets. For example, a tool has been built to create vertical slots that moves to connect its holes because the abrasive jets cannot be placed close enough together to allow them to cut a slot simultaneously. Alternatively, situations that require a casing window may need a large circle or oval shape for their processes.

The following patents and publications are representative of conventional abrasive jet perforating and cutting tools, along with apparatuses and methods that may be employed with the tools.

U.S. Pat. No. 3,130,786 by R. W. Brown et al., "Perforating Apparatus", Apr. 28, 1964, discloses an abrasive jet perforating tool. The tool comprises a cylindrical conduit for abrasive fluid to be pumped through and jet nozzles laterally extending from the conduit to direct the abrasive fluid through the casing into the surrounding formation. Factors such as the pressure differential and the ratios of the diameter of the nozzle orifice to the length of the nozzles and to the size of the abrasives are kept within predetermined limits for optimum penetration.

U.S. Pat. No. 3,145,776 by F. C. Pittman, "Hydra-Jet Tool", Aug. 25, 1964, discloses protective plates for an abrasive jet perforating tool. The plates, made of abrasive resistant material, are designed to fit flatly to the body of the tool around the perforating jets. The plates are employed to protect the body of the tool from ejected abrasive material that rebounds. The protective plates disclosed in Pittman are not designed to protect the abrasive jets themselves.

U.S. Pat. No. 3,266,571 by J. C. St. John et al., "Casing Slotting", Aug. 16, 1966, discloses an abrasive jet perforating tool designed to cut slots of controlled length. The slot lengths are controlled by abrasive resistant shields attached to the tool to block the flow from rotating abrasive jets.

U.S. Pat. No. 4,050,529 by K. M. Tagirov et al., "Apparatus for Treating Rock Surrounding a Wellbore", Sep. 27 1977, discloses an abrasive jet tool for successively perforating and then fracturing reservoirs. The nozzles of the abrasive jets are designed to snugly fit against the casing to allow perforating at one pressure immediately followed by fracturing at a higher pressure.

U.S. Pat. No. 5,499,678 by J. B. Surjaatmadja et al., "Coplanar Angular Jetting Head for Well Perforating", Mar. 19 1996, discloses a jetting head for use in an abrasive jet perforating tool. The jet openings in the jetting head are coplanar and positioned at an angle to the longitudinal axis of the tool. The angle is chosen so that the plane of the jet openings is perpendicular to the axis of least principal stress in the formation being fractured. The tool must be custom-made for each job, since the entire jet head is angled into the tool.

U.S. Pat. No. 5,765,756 by G. D. Jorden et al., "Abrasive Slurry Jetting Tool and Method", Jun. 16, 1998, discloses an abrasive jet perforating tool with telescoping jetting nozzles. The jetting nozzles are operated perpendicularly to the longitudinal axis of the tool body, although the nozzle assemblies can pivot back into the tool body for retrieval back up the wellbore. The Jordan et al. patent discloses using the perforating tool for removing a casing section, cutting a window, series of longitudinal slots, or plurality of perforations in a wellbore casing, and removing or cleaning a wellbore formation to enhance perforation.

U.S. Pat. No. 7,159,660 B2 by D. M. Justus, "Hydrajet Perforating and Fracturing Tool", Jan. 9, 2007, discloses an abrasive jet perforating and fracturing tool. The tool comprises both abrasive jet ports and fracturing ports having larger apertures than the jet ports. The fracturing ports are used to eject fracturing fluid into the formation at a faster rate than possible through the jet ports. The tool further comprises a rotating sleeve, turned by a power unit, with apertures that align or misalign with the jet ports and control ports to control flow through the ports.

U.S. Pat. No. 7,497,259 B2, by L. J. Leising et al., "System and Method for Forming Cavities in a Well", Mar. 3, 2009, discloses a downhole assembly string for perforating wells. The string comprises an anchoring mechanism, a multi-cycle vertical incrementing tool, a swivel orienting device and a perforation tool, suspended from coiled tubing. The perforation tool is moved vertically by the incrementing tool, which is activated by fluid pressure changes.

An SPE publication by J. S. Cobbett, "Sand Jet Perforating Revisited", SPE 55044, SPE Drill. & Completion, Vol. 14, No. 1, p. 28-33, March 1999, discloses the use of sand jet perforating (abrasive jet perforating) with coiled tubing to increase production in damaged wells, using examples of neglected wells in Lithuania.

A publication by Gensheng Li et al., "Abrasive Water Jet Perforation—An Alternative Approach to Enhance Oil Production", *Petroleum Science and Technology*, Vol. 22, Nos. 5 & 6, p. 491-504, 2004, discloses laboratory results and field tests showing the effects of different parameters on the ability of abrasive water jet perforating (abrasive jet perforating) to improve well performance and the mechanism by which it works.

Halliburton Document HO4903, "Hydra-Jet Perforating Process Service" September 2006 discloses an abrasive jet perforating tool and process. The perforating tool is conveyed by coiled tubing to allow access to deviated or horizontal wellbores, damaged casing, or other tight restrictions.

SPE publication by S. W. Loving et al., "Abrasive Cutting Technology Deployed Via Coiled Tubing", SPE 92866, SPE/ICoTA Coiled Tubing Conference and Exhibition, April 2005, discloses an abrasive jet cutting tool for cutting production tubing, drill pipe, drill collars, completion components, and casing strings. The cutting tool is deployed using conventional coiled tubing and is rotated by pumping an abrasive slurry through a downhole sealed bearing, positive displacement motor mounted above an abrasive cutting head. The abrasive slurry is pumped down the coiled tubing by a conventional high pressure pump.

SPE publication by B. W. McDaniel et al, "Use of Hydrajet Perforating To Improve Fracturing Success Sees Global Expansion" SPE 114695, CIPC/SPE Gas Tech. Symposium June, 2008, discloses the history of hydrajet-assisted fracturing (HJAF), the use of abrasive jet perforating in conjunction with hydraulic fracturing. The combination of hydrajet perforating and hydraulic fracturing can increase well production while reducing well costs over previous stimulation methods.

Thus, a need exists for an abrasive jet perforating tool and method of use that can provide better protection around the installation locations of the jet orifices and can be used in pipe with a small inner diameter.

BRIEF SUMMARY OF THE INVENTION

The invention is an apparatus and a method for providing improved abrasive jet perforating in wells. In one embodiment, the invention is an abrasive jet perforating tool comprising a generally cylindrically shaped tube with a side, an upper portion, and a lower portion; a plurality of smooth holes drilled into the side of the tube; abrasive jets mounted in at least some of the plurality of smooth holes; protective plates mounted in the side of the tube and surrounding the abrasive jets to hold the abrasive jets in place; wafers recessed into pockets on the protective plates and surrounding the abrasive jets to protect the abrasive jets from damage due to rebound of abrasive-carrying fluid slurry ejected by the abrasive jets; and fasteners securing the protective plates to the side of the tube and positioned away from the rebound of abrasive-carrying fluid slurry ejected by the abrasive jets.

In another embodiment, the invention is a method for performing abrasive jet perforating, comprising determining well parameters for a well; assembling an abrasive jet perforating tool according to the well parameters, wherein the abrasive jet perforating tool is the apparatus described above; and perforating the well with the assembled abrasive jet perforating tool.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION OF THE INVENTION

The purpose of this invention is to provide a method and apparatus for improved abrasive jet perforating in wells. The invention includes a new design that better protects the perforating tool from damage due to splash back of the abrasive slurry while reducing space requirements for the jets. These improvements create a longer lasting abrasive jet perforating tool with abrasive jet locations that can be oriented in ways that were not formerly possible. Jets can be grouped together to form slots, custom shaped holes, or very large holes. The reduced space requirements also allow this tool to be miniaturized for use in wells with small inner diameters.

In one embodiment, the invention is an apparatus for performing abrasive jet perforating. That is, the invention is an abrasive jet perforating tool. In another embodiment, the invention is a method for performing abrasive jet perforating. That is, the invention includes a method for using the abrasive jet perforating tool of the invention.

Figure 1:
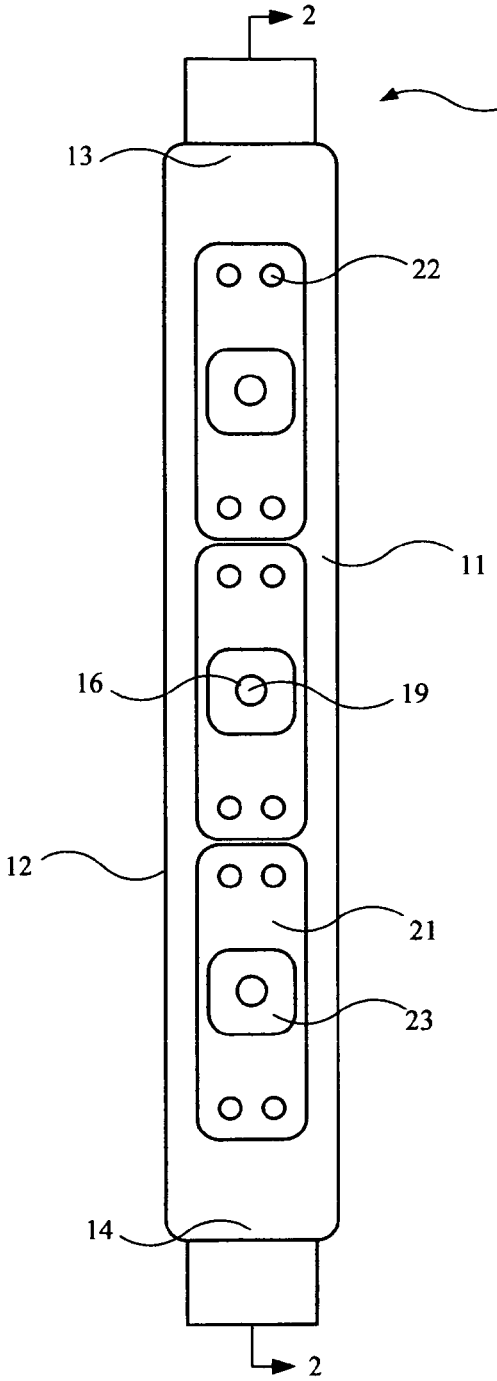
FIG. 1 shows a schematic side view of a general embodiment of the abrasive jet perforating tool of the invention.
Figure 2:
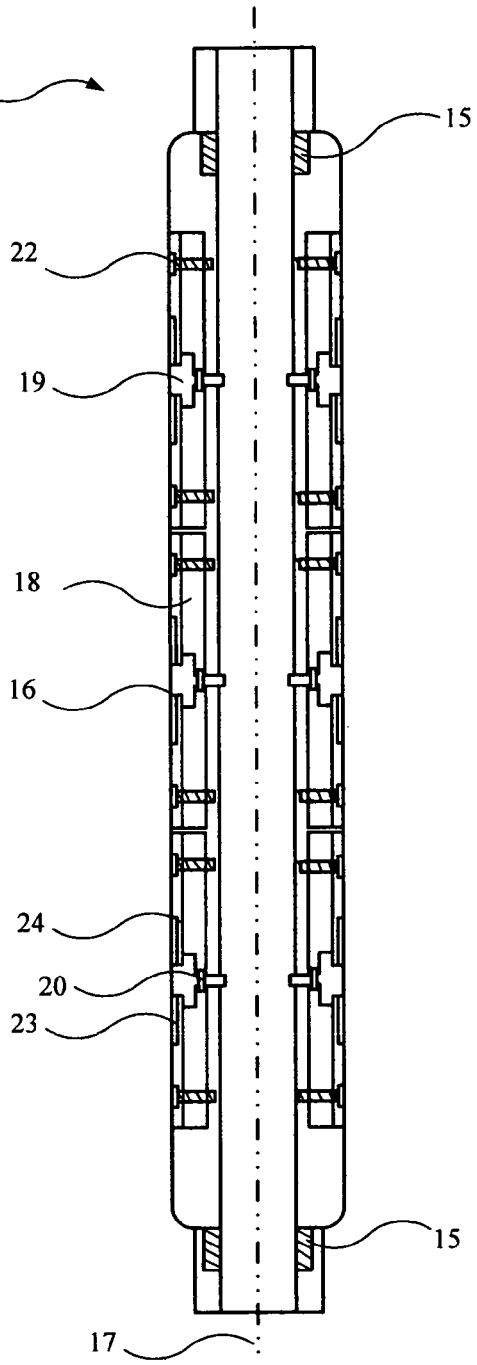
FIG. 2 shows a schematic sectional view of the same general embodiment of the abrasive jet perforating tool shown in FIG. 1.

FIG. 1 shows a schematic side view of a general embodiment of the abrasive jet perforating tool of the invention. FIG. 2 shows a schematic sectional view of the same general embodiment of the abrasive jet perforating tool shown in FIG. 1. The sectional view of FIG. 2 is taken along the broken line 2-2 in FIG. 1. Depending on the specific application, the general embodiment may use one or more variations to this basic configuration. FIGS. 3-7 show various views of alternative embodiments of the abrasive jet perforating tool of the invention shown in FIGS. 1 and 2.

The abrasive jet perforating tool of the invention is designated generally by reference numeral 10 in FIGS. 1-3 and 6-7. In FIGS. 1 and 2, the main tool body 11 of the abrasive jet perforating tool 10 comprises a conduit, preferably in the form of a generally cylindrically shaped tube. Although the abrasive jet perforating tool 10 is illustrated here with the preferred embodiment of the tool body 11 as a tube, this cylindrical shape is not necessarily a limitation of the invention. The tool body 11 could have other appropriate shapes in other alternative embodiments. The tool body 11 further comprises a side 12, an upper portion 13, and a lower portion 14. There are threaded connection fittings 15 (shown in FIG. 2) on the upper portion 13 and on the lower portion 14 of the tool body 11. The threaded connection fittings on the upper portion 13 and lower portion 14 of the tool body 11 are used to connect the abrasive jet perforating tool 10 to other components of the well string above and below, respectively, the abrasive jet perforating tool 10.

The tool body 11 further comprises at least one smooth hole 16 drilled into the side 12 of the tool body 11. In a preferred embodiment, the tool body 11 will have a plurality of the smooth holes 16 in multiple locations. In a preferred embodiment, illustrated here, the smooth holes 16 are oriented in a direction that is perpendicular, or near perpendicular, to the longitudinal axis 17 (shown in FIG. 2) of the tool body 11. However, a perpendicular orientation of the smooth holes 16 is not intended to be a limitation of the invention, as is illustrated below in FIGS. 6 and 7. In another embodiment, the tool body 11 may also have pockets 18 (shown in FIG. 2) or machined flat areas on the side 12 of the tool body 11 surrounding the smooth holes 16.

The abrasive jet perforating tool 10 further comprises abrasive jets 19 (nozzles) mounted in at least some of the smooth holes 16 located in the side 12 of the tool body 11. The abrasive jets 19 further comprise jetting orifices (41 in FIGS. 4 and 51 in FIG. 5). The jetting orifices 41, 51 are preferably constructed from carbide. Other appropriate materials for the jetting orifices 41, 51 include, but are not limited to, boron carbide, tungsten carbide, silicon nitride, alumina, a steel alloy with a protective coating, and ceramics such as cubic zirconium. The abrasive jets 19 are mounted with seals 20 in the smooth holes 16 on the tool body 11. In a preferred embodiment, the seals 20 are O-ring type gaskets. However, the type of seal is not intended to be a limitation of the invention. In other alternative embodiments, the seals 20 may be any appropriate means for sealing.

A protective plate 21 is then placed over each abrasive jets 19 and secured to the tool body 11 with fasteners 22 rigidly fixing the protective plate 21 so that the abrasive jets 19 are held in place. In a preferred embodiment, illustrated here, the fasteners 22 are screws. However, the type of fastener 22 employed is not intended to be a limitation of the invention. Any appropriate type of fastener 22 may be employed. The mounting locations of the fasteners 22 are positioned far enough away from the abrasive jets 19 so as to not sustain damage from damage due to rebound (splash back) of abrasive-carrying fluid slurry ejected by the abrasive jets. Conventional abrasive jet perforating tools have typically used a threaded abrasive jet that is screwed into the tool body. In contrast, the present invention uses abrasive jets 19 inserted into smooth holes 16 in the side 12 of the tool body 11 and held in place by protective plates 21 secured by fasteners 22 positioned away from the splash back of abrasive slurry.

Additionally, with conventional small outer diameter tools currently in operation, the abrasive jets 19 can become damaged beyond repair and are extremely difficult to remove from the tool body 11. Often, the abrasive jets 19 must be closed in completely with a welder. The invention allows for the easy removal of the expendable parts because the mounting screws 22 are located away from the area damaged by abrasive slurry splash back.

The protective plate 21 further contains a wafer 23 recessed into a pocket 24 (shown in FIG. 2) in the protective plate 21. The wafers 23 surround the abrasive jets 19 to protect the abrasive jets 19 from damage due to rebound of abrasive-carrying fluid slurry ejected by the abrasive jets 19. The wafers 23 are preferably constructed from carbide (or similar appropriate material). Other appropriate materials for the wafers 23 include, but are not limited to, boron carbide, tungsten carbide, silicon nitride, alumina, a steel alloy with a protective coating, and ceramics such as cubic zirconium.

Depending on the specific application, alternative embodiments of the abrasive jet perforating tool 10 may use one or more variations to the general embodiment illustrated in FIGS. 1 and 2. Some of these possible alternative embodiments are illustrated in FIGS. 3-7.

Figure 3:
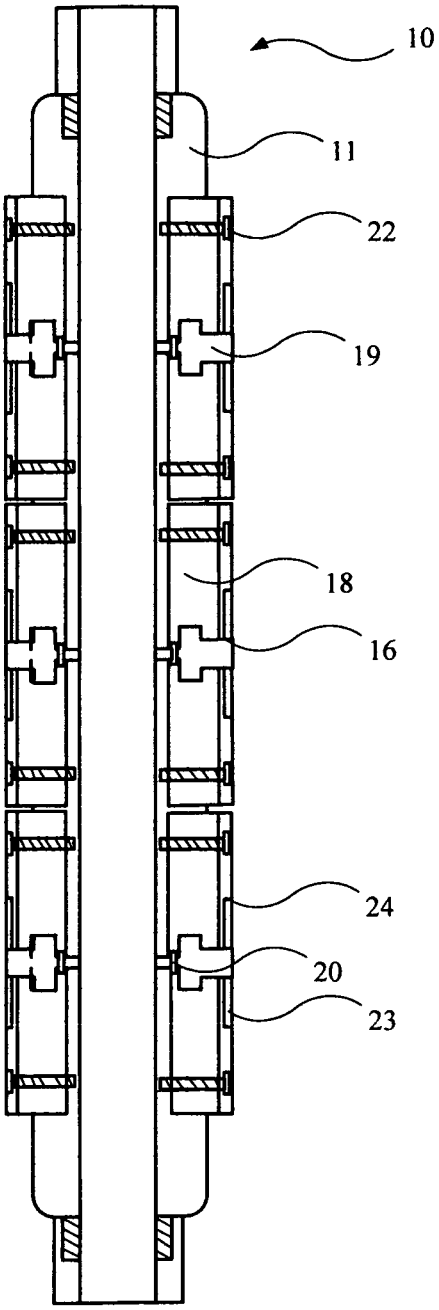
FIG. 3 shows a schematic sectional view of an alternative embodiment of the abrasive jet perforating tool of the invention.

FIG. 3 shows a schematic sectional view of an alternative embodiment of the abrasive jet perforating tool of the invention. As in FIG. 2, the sectional view of FIG. 3 is taken along the broken line 2-2 in FIG. 1. The thickness of the protective plates 21 is increased so that they extend beyond the outer diameter of the side 12 of the tool body 11. This would provide for the protective plates 21 to act as centralizers and thus allow for a tool body 11 of a single size to be used for multiple casing sizes. The abrasive jets 19 would also be lengthened to match. Using abrasive jets 19 of different lengths in conjunction with the protective plates 21 allows one basic abrasive jet perforating tool 10 to he used in wells of varying sizes. This will also decrease costs by requiring fewer sizes of the abrasive jet perforating tool 10 in inventory.

Figure 4:
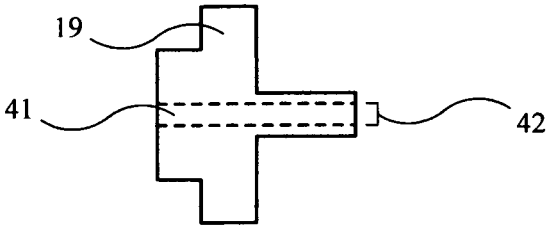
FIG. 4 shows a schematic side view of an embodiment of the abrasive jets shown in FIGS. 1-3 and 6-7.

FIG. 4 shows a schematic side view of an embodiment of the abrasive jets shown in FIGS. 1-3 and 6-7. The abrasive jet 19 may contain a jetting orifice 41 comprising an insert that has a uniform inner diameter 42. The purpose of the uniform inner diameter is to create a perforation hole that is typically two to three times the size of the inner diameter 42 of the jetting orifice 41.

Figure 5:
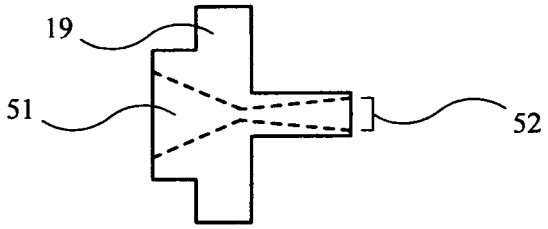
FIG. 5 shows a schematic side view of an alternative embodiment of the abrasive jets shown in FIGS. 1-3 and 6-7.

FIG. 5 shows a schematic side view of an alternative embodiment of the abrasive jets shown in FIGS. 1-3 and 6-7. The abrasive jet 19 may contain a jetting orifice 51 comprising an insert that has an inner diameter that first tapers then expands to create a venturi style jet 52. The purpose of the venturi jet 52 is to provide a resulting spray that increases in outer diameter at a rate that is typically four to ten times greater than that of the uniform inner diameter 42 shown in FIG. 4, thus creating a larger diameter perforation hole.

Figure 6:
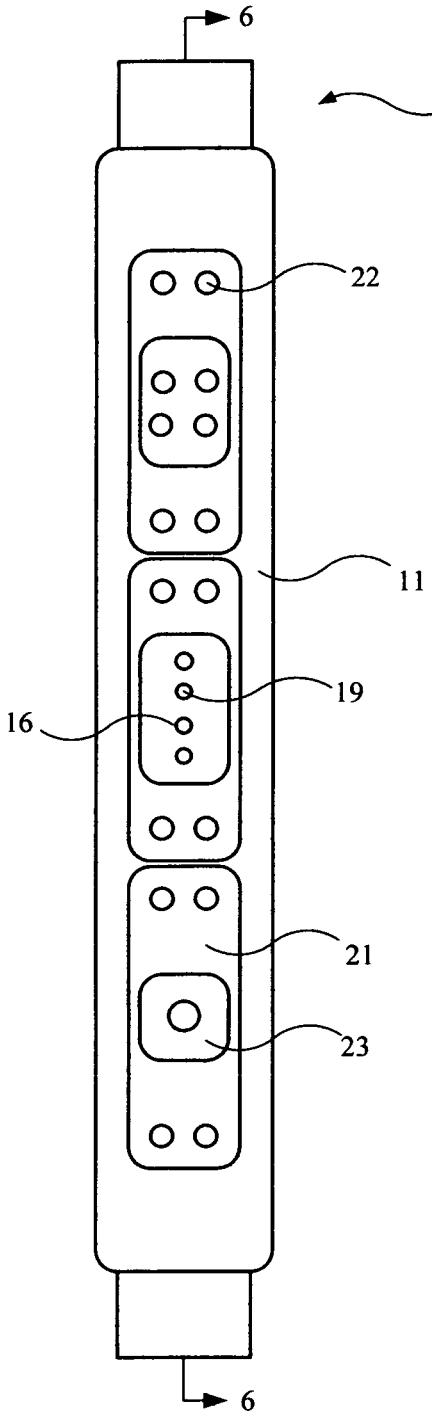
FIG. 6 shows a schematic side view of alternate embodiments of the abrasive jet perforating tool of the invention.
Figure 7:
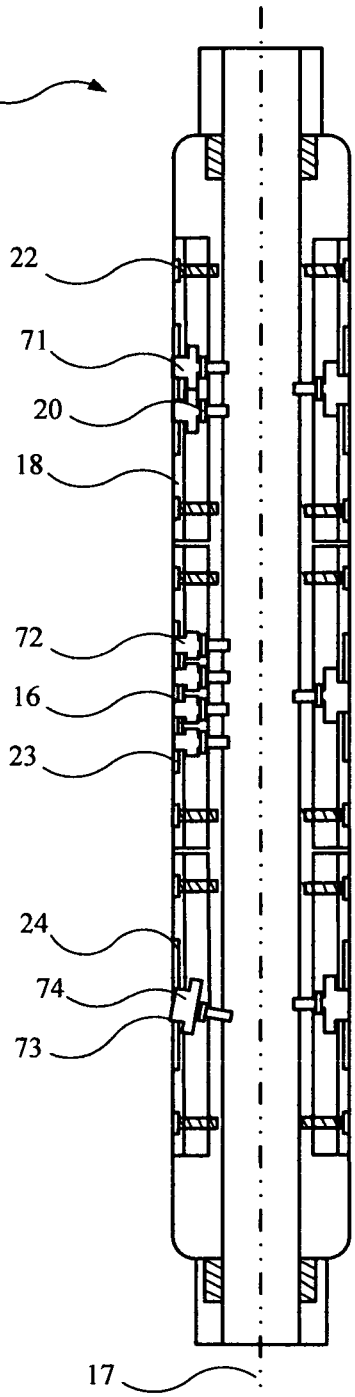
FIG. 7 shows a schematic sectional view of the same alternate embodiments of the abrasive jet perforating tool shown in FIG. 6.

FIG. 6 shows a schematic side view of alternate embodiments of the abrasive jet perforating tool of the invention. FIG. 7 shows a schematic sectional view of the same alternate embodiments of the abrasive jet perforating tool shown in FIG. 6. The sectional view of FIG. 7 is taken along the broken line 6-6 in FIG. 6.

In an alternative embodiment, illustrated in FIGS. 6 and 7, multiple smooth holes 16 are drilled in the side 12 of the tool body 11 under a single protective plate 21. Thus, multiple abrasive jets 71, 72 are positioned under a single protective plate 21. This arrangement of abrasive jets 71, 72 allows for the cutting of larger or uniquely shaped holes or slots by allowing for multiple abrasive jets 71, 72 to be located in very close proximity to each other.

In an alternative embodiment, illustrated in FIGS. 6 and 7, the smooth holes 73 are oriented in a direction that is at a substantive angle from perpendicular to the longitudinal axis 17 of the tool body 11. Thus, the abrasive jets 74 are also at a substantive angle from perpendicular to the longitudinal axis 17 of the tool body 11. This alternative embodiment would allow for the perforating of angled holes if desired. This alternative embodiment also provides superior protection for angled jets beneath the protective plate. A variety of different orifice insert quantities, orifice sizes, and placement locations can be used with the improvements listed for this tool.

The abrasive jet perforating tool of the invention can be scaled down to an outer diameter of, for example, 1⅞ inches for the tool body 11, or even smaller. Even at the smaller diameters, the invention provides protection to, and thus extends the life of, the abrasive jet perforating tool 10. The tool body 11 of the invention can be reused many times while changing only the jetting orifices 41, 51 and protective plates 21. This is unique in the smaller tool size.

The apparatus of the invention can also be scaled up to an outer diameter of, for example, 3 inches for the tool body 11. At the larger diameters, the invention provides superior protection to previous designs by uniformly protecting the area around the abrasive jets 19 with a solid piece of carbide wafer 23. This eliminates the areas vulnerable to abrasive slurry splash back around the installation locations of the abrasive jets 19.

Figure 8:
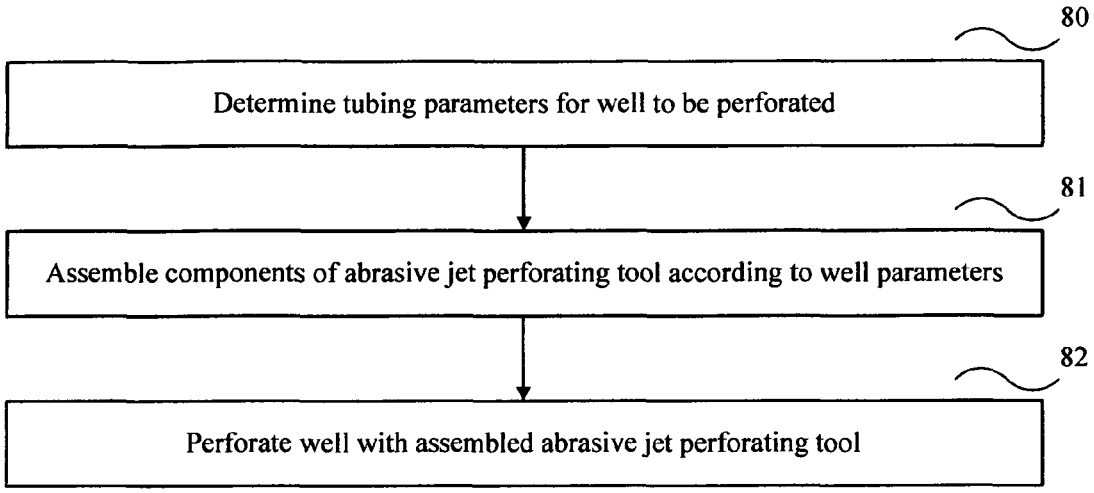
FIG. 8 shows a flowchart illustrating an embodiment of the method of the invention for performing abrasive jet cutting in a wellbore.

In another embodiment, the invention is a method for performing abrasive jet perforating, using the abrasive jet perforating tool of the invention, described above. FIG. 8 is a flowchart illustrating an embodiment of the method of the invention for performing abrasive jet perforating.

At block 80, parameters are determined for a well to be perforated. These well parameters include, but are not limited to, the type and thickness of casing, the type and thickness of cement, the type of reservoir rock to be encountered in the zones to be perforated, and the depth of the zones to be perforated.

At block 81, the appropriate components of an abrasive jet perforating tool are assembled according to the well parameters determined in block 80. The abrasive jet perforating tool is the tool of the present invention, as described above with reference to FIGS. 1-7. The assembly of the tool can take place onsite or off-site, wherever is convenient. If the tool is assembled offsite, then the tool is shipped to the well site, where the tool assembly can be easily changed if the well parameters have changed or turn out to be different than originally expected.

At block 82, the well is perforated with the abrasive jet perforating tool assembled in block 81.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

I claim:

1. An apparatus for performing abrasive jet perforating in a well, comprising:

a generally cylindrical shaped tube with a side, an upper portion, and a lower portion;

protective plates mounted in the side of the tube;

a plurality of smooth holes drilled into the side of the tube and the protective plates;

abrasive jets mounted in at least some of the plurality of smooth holes in the tube;

wafers recessed into pockets on the protective plates and surrounding the abrasive jets to protect the abrasive jets from damage due to rebound of abrasive-carrying fluid slurry ejected by the abrasive jets; and fasteners securing the protective plates to the side of the tube and positioned away from the rebound of abrasive-carrying fluid slurry ejected by the abrasive jets;

wherein the protective plates surround the abrasive jets to mechanically hold the abrasive jets in place with respect to the protective plates, wherein at least a first of the protective plates has a first configuration of smooth holes and at least a second of the protective plates has a second configuration of smooth holes different from the first configuration.

2. The apparatus of claim 1, wherein the smooth holes are oriented in a direction that is near perpendicular to a longitudinal axis of the tube.

3. The apparatus of claim 1, wherein the smooth holes are oriented in a direction that is at an angle from perpendicular to a longitudinal axis of the tube.

4. The apparatus of claim 1, wherein the abrasive jets comprise jetting orifices having a uniform interior diameter.

5. The apparatus of claim 1, wherein the abrasive jets comprise jetting orifices having a venturi style jet.

6. The apparatus of claim 1, wherein the protective plates extend radially out from the side of the tube and surround the abrasive jets.

7. The apparatus of claim 1, wherein the fasteners comprise screws.

8. The apparatus of claim 1, wherein the tube further comprises threaded connection fittings on the upper portion and on the lower portion to connect the tube other components in a well string.

9. A method for performing abrasive jet perforating, comprising:

determining well parameters for a well;

assembling an abrasive jet perforating tool according to the well parameters, wherein the abrasive jet perforating tool comprising:

a generally cylindrical shaped tube with a side, an upper portion, and a lower portion;

protective plates mounted in the side of the tube;

A plurality of smooth holes drilled into the side of the tube and the protective plates;

abrasive jets mounted in at least some of the plurality of smooth holes in the tube;

wafers recessed into pockets on the protective plates and surrounding the abrasive jets to protect the abrasive jets from damage due to rebound of abrasive-carrying fluid slurry ejected by the abrasive jets; and fasteners securing the protective plates to the side of the tube and positioned away from the rebound of abrasive-carrying fluid slurry ejected by the abrasive jets, wherein the protective plates surround the abrasive jets to mechanically hold the abrasive jets in place with respect to the protective plates, wherein at least a first of the protective plates has a first configuration of smooth holes and at least a second of the protective plates has a second configuration of smooth holes different from the first configuration;

Perforating the well with the assembled abrasive jet perforating tool.

* * * * *